US010871735B2

(12) United States Patent
Kawai et al.

(10) Patent No.: US 10,871,735 B2
(45) Date of Patent: Dec. 22, 2020

(54) IMAGE HEATING DEVICE

(71) Applicant: CANON KABUSHIKI KAISHA, Tokyo (JP)

(72) Inventors: Hiroki Kawai, Abiko (JP); Mitsuru Hasegawa, Tsukubamirai (JP); Suguru Takeuchi, Funabashi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/669,117

(22) Filed: Oct. 30, 2019

(65) Prior Publication Data

US 2020/0133174 A1 Apr. 30, 2020

(30) Foreign Application Priority Data

Oct. 31, 2018 (JP) ..... 2018-204738

(51) Int. Cl.
*G03G 15/20* (2006.01)

(52) U.S. Cl.
CPC ... *G03G 15/205* (2013.01); *G03G 2215/2003* (2013.01); *G03G 2215/2016* (2013.01); *G03G 2215/2035* (2013.01); *G03G 2215/2038* (2013.01); *G03G 2215/2041* (2013.01)

(58) Field of Classification Search
CPC ..... G03G 15/205; G03G 2215/2003; G03G 2215/2016; G03G 2215/2035; G03G 2215/2038; G03G 2215/2041
See application file for complete search history.

(56) References Cited

U.S. PATENT DOCUMENTS 5,262,834 A * 11/1993 Kusaka ..... G03G 15/2003 219/216
2011/0021714 A1* 1/2011 Gilmartin ..... C07F 9/65815 525/340
2011/0135350 A1* 6/2011 Barton ..... G03G 15/2028 399/323
2013/0078470 A1* 3/2013 Murase ..... G03G 15/2057 428/411.1
2014/0064803 A1* 3/2014 Okabayashi ..... G03G 15/2064 399/329
2014/0270870 A1* 9/2014 Amano ..... G03G 15/2064 399/329
2014/0286683 A1* 9/2014 Nakamura ..... G03G 15/2053 399/329
2014/0348558 A1 11/2014 Inoue et al.
2017/0269525 A1* 9/2017 Okamoto ..... G03G 15/2017
2017/0269526 A1* 9/2017 Yuasa ..... G03G 15/2032
2019/0056686 A1* 2/2019 Yagi ..... G03G 15/2057

FOREIGN PATENT DOCUMENTS

JP 09218602 A * 8/1997 ..... G03G 15/2064
JP 2011-123194 A 6/2011
JP 2014-228765 A 12/2014
JP 2017-9784 A 1/2017

* cited by examiner

*Primary Examiner* — Ryan D Walsh
(74) *Attorney, Agent, or Firm* — Venable LLP

(57) ABSTRACT

A fixing device including a fixing belt having a maximum curvature in a rotational direction of the fixing belt. The number of times the fixing belt is bent when a temperature of the fixing belt is equal to or lower than a glass transition temperature of the fixing belt surface material is controlled to operate within a specified range.

8 Claims, 8 Drawing Sheets

IMAGE HEATING DEVICE

CROSS-REFERENCE TO RELATED APPLICATION

This application claims the benefit of Japanese Patent Application No. 2018-204738 filed on Oct. 31, 2018, which is hereby incorporated by reference herein in its entirety.

FIELD OF THE INVENTION AND RELATED ART

The present invention relates to an image heating device that heats an image formed on a recording material.

In recent years, the on-demand printing market has grown, in which commercial prints such as catalogs, posters, brochures, and so on are printed according to the required number of copies, and/or printing is carried out continuously while changing a portion of the contents of printing such as various invoices and direct mail for each customer. Therefore, an electrophotographic image forming apparatus which can handle various recording material is attracting attention.

In an electrophotographic image forming apparatus, there is a movement to expand the applicable basis weight range in order to meet the variety of recording materials required. Among them, there is great demand for printing on thin sheets (paper) having a smaller basis weight. Thin sheet is less rigid and easy to wind around the fixing belt by the adherence of the toner, resulting in sheet separation failure. To prevent such sheet peeling failure, developing a good thin sheet peeling technology is desired.

In the fixing device disclosed in Japanese Laid-open Patent Application No. 2014-228765, by causing the fixing belt to follow a fixing pad with a predetermined curvature, a predetermined curvature is provided on the fixing belt. By increasing this curvature, separation is possible even when the thin sheet has a smaller basis weight.

As described above, the portion of the fixing belt where a large curvature is given acquires a tendency (reformation, habit) of the large curvature shape with the result of appearance of marks like a crease remaining on the belt surface.

Usually, such a mark is removed when heated to near the glass transition temperature of the belt surface member material, but when the belt curvature is increased to a certain amount or more, and the belt is bent more than a certain number of times, the above-mentioned mark may remain unremoved in some cases.

As a result, the pattern of the surface of the fixing belt where the mark remains is transferred onto the image, resulting in a defective image.

SUMMARY OF THE INVENTION

It is an object of the present invention to provide an image heating device which starts image formation after reducing belt bending which has occurred before the image formation is started.

According to one aspect, the present invention provides an image heating device for heating an image formed on a recording material. The image heating device includes a heating source, a rotatable belt member, a pressing rotatable member, a pressing member, a tension member, and a controller. The rotatable belt member is capable of being heated by the heating source to heat the image formed on the recording material. The belt member includes an elastic layer and a surface layer formed of a fluororesin. The pressing rotatable member is configured to press the belt to form a nip portion for nipping and feeding the recording material. The pressing member is provided inside the belt member and configured to press the pressing rotatable member through the belt member. The tension member is configured to stretch the belt member. The belt member is stretched by the pressing member and the tension member with a portion thereof having a maximum curvature of 0.17 $mm^{-1}$ or more in a circumferential direction of the belt member as measured when the belt member is at rest. The controller is configured to execute, in a case that an operation signal is inputted when the belt member is at rest and has a temperature lower than 50° C., a start-up mode operation in which the belt member is rotated, and an outer surface temperature of a portion of the belt member having the maximum curvature is raised up to 100° C. or higher before a number of rotations of the belt member reaches ten.

Further features of the present invention will become apparent from the following description of exemplary embodiments with reference to the mounted drawings.

DESCRIPTION OF THE EMBODIMENTS

In the following, embodiments of an image forming apparatus according to the present invention will be described with reference to the drawings. Hereafter, an example in which the present invention is applied to an electrophotographic full-color image forming apparatus including a plurality of photosensitive drums will be described, but the present invention is not limited to such an apparatus and can be applied to various types of image forming apparatuses, including monochromatic image forming apparatuses, and the like.

Embodiment 11

<Image Forming Apparatus>

Figure 2:
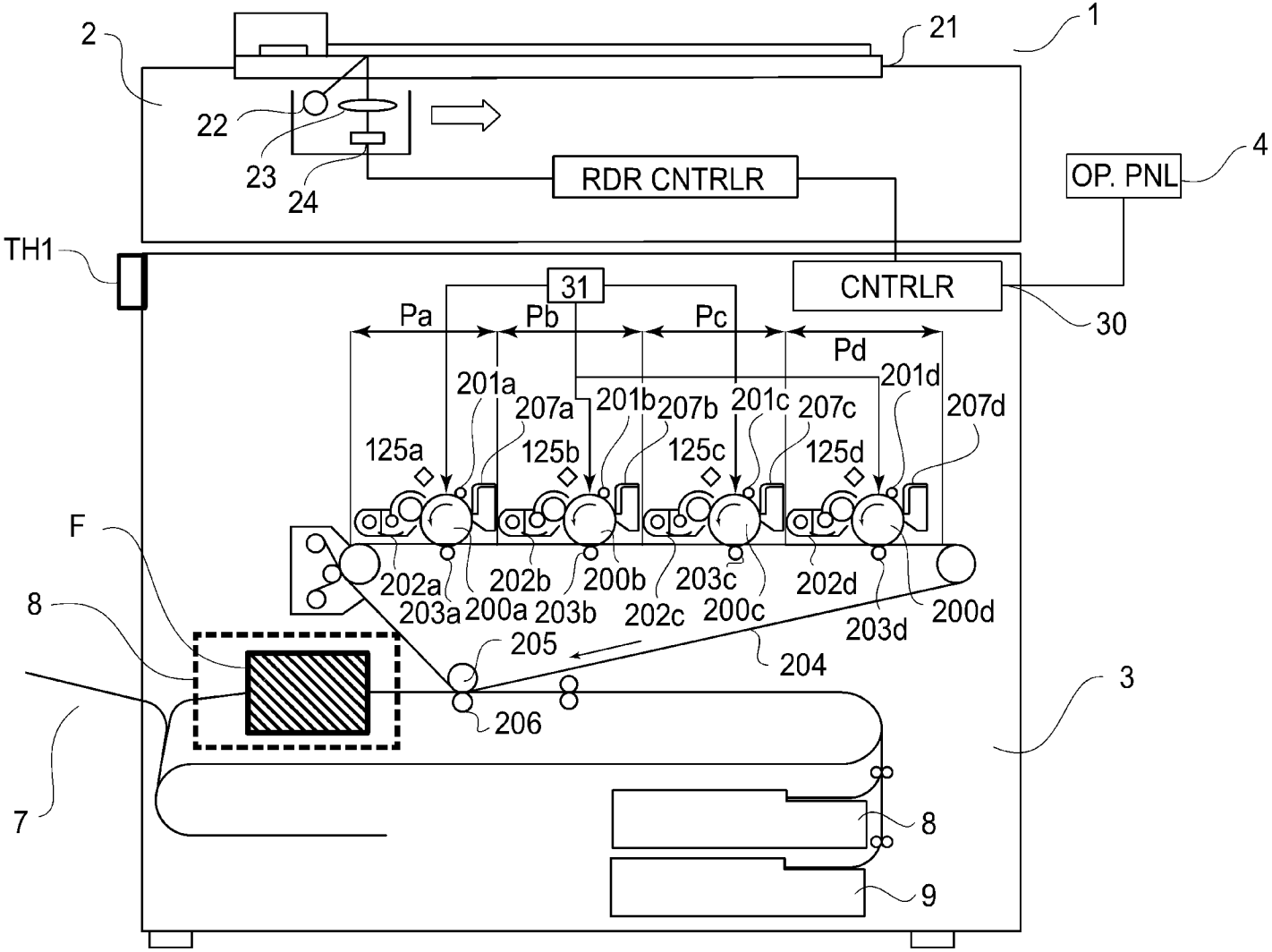
FIG. 2 is a schematic illustration of an image forming apparatus.

Referring to FIG. 2, a structure of the image forming apparatus of this embodiment will be described.

FIG. 2 is an illustration showing a full-color image forming apparatus according to this embodiment. The image forming apparatus 1 includes an image reading portion 2 and an image forming apparatus main assembly 3. The image reader 2 reads the original placed on the platen glass 21, and the light emitted from the light source 22 is reflected by the original and imaged on the CCD sensor 24 by way of the optical system member 23 such as a lens. Such an optical system unit scans in the direction of the arrow to convert the original into an electric signal data string for each line. The image signal obtained by the CCD sensor 24 is fed to the image forming apparatus main assembly 3, and a controller 30 performs image processing according to each image forming portion which will be described hereafter. In addition, the controller 30 also receives an external input from an external host device such as a print server as an image signal.

The image forming apparatus main assembly 3 includes a plurality of image forming portions Pa, Pb, Pc, Pd, and each image forming portion performs image forming operation based on the above-described image signal. That is, the image signal is converted into a laser beam subjected to PWM control (pulse width modulation control) by the controller 30. In FIG. 2, a polygon scanner 31 is an exposure device that deflects a laser beam according to the image signal. And, the laser beam is irradiated to the photosensitive drums 200*a* to 200*d* as image bearing members of the image forming portions Pa to Pd.

Here, Pa is the yellow (Y) image forming portion, Pb is a magenta (M) image forming portion, Pc is a cyan (C) image forming portion, and Pd is the black (Bk) image forming portion, which form corresponding color images. Since the image forming portions Pa to Pd are substantially the same, details of the Y image forming portion Pa will be described below, and descriptions of the other image forming portions will be omitted for the sake of simplicity. In Y image forming portion Pa, a toner image is formed on the surface of a photosensitive drum 200*a* based on the image signal as will be described below.

A primary charging device 201*a* charges the surface of the photosensitive drum 200*a* to a predetermined potential and prepares the surface of the photosensitive drum 200*a* for the formation of an electrostatic latent image. An electrostatic latent image is formed on the surface of the photosensitive drum 200*a* that has been charged to a predetermined potential by the laser beam from the polygon scanner 31. A developer 202*a* develops an electrostatic latent image on the photosensitive drum 200*a* to form a toner image. A transfer roller 203*a* electrically discharges at the back side of an intermediary transfer belt 204 with a primary transfer bias having a polarity opposite to that of the toner applied to transfer the toner image from the photosensitive drum 200*a* onto the intermediary transfer belt 204. The surface of the photosensitive drum 200*a* after the transfer is cleaned by a cleaner 207*a*.

In addition, the toner image on the intermediary transfer belt 204 is fed to the next image forming portion, and in the order of Y, M, C, and Bk, the toner images of the respective colors formed in the respective image forming portions are sequentially transferred, so that four color images are formed on the surface. The toner image which has passed through the Bk image forming portion reaches the secondary transfer portion comprising a secondary transfer roller pair 205, 206, where a secondary transfer electric field having a polarity opposite to that of the toner image on the intermediary transfer belt 204 is applied, by which the image is secondarily transferred onto the paper (sheet) P. The fed sheet is held at a registration portion 208 and then fed out from the registration portion at such a controlled timing as to align the toner image on the intermediary transfer belt with the sheet. Thereafter, the toner image on the sheet is fixed thereon by a fixing device F as an image heating device. After passing through the fixing device F, the sheet is discharged out of the machine. In the case of double-sided jobs, when the transfer and fixing of the toner on the first image forming surface (first surface) is completed, the sheet is passed, after fixing, through a reversing portion provided inside the image forming apparatus, in which the front and back of the sheet are reversed, and the image is transferred and fixed on the second side (second side), and then the sheet is discharged out of the machine and stacked on the sheet discharge tray 7.

Next, referring to FIG. 1, the structure of the fixing device F in this embodiment will be described.

<Fixing Device>

Figure 1:
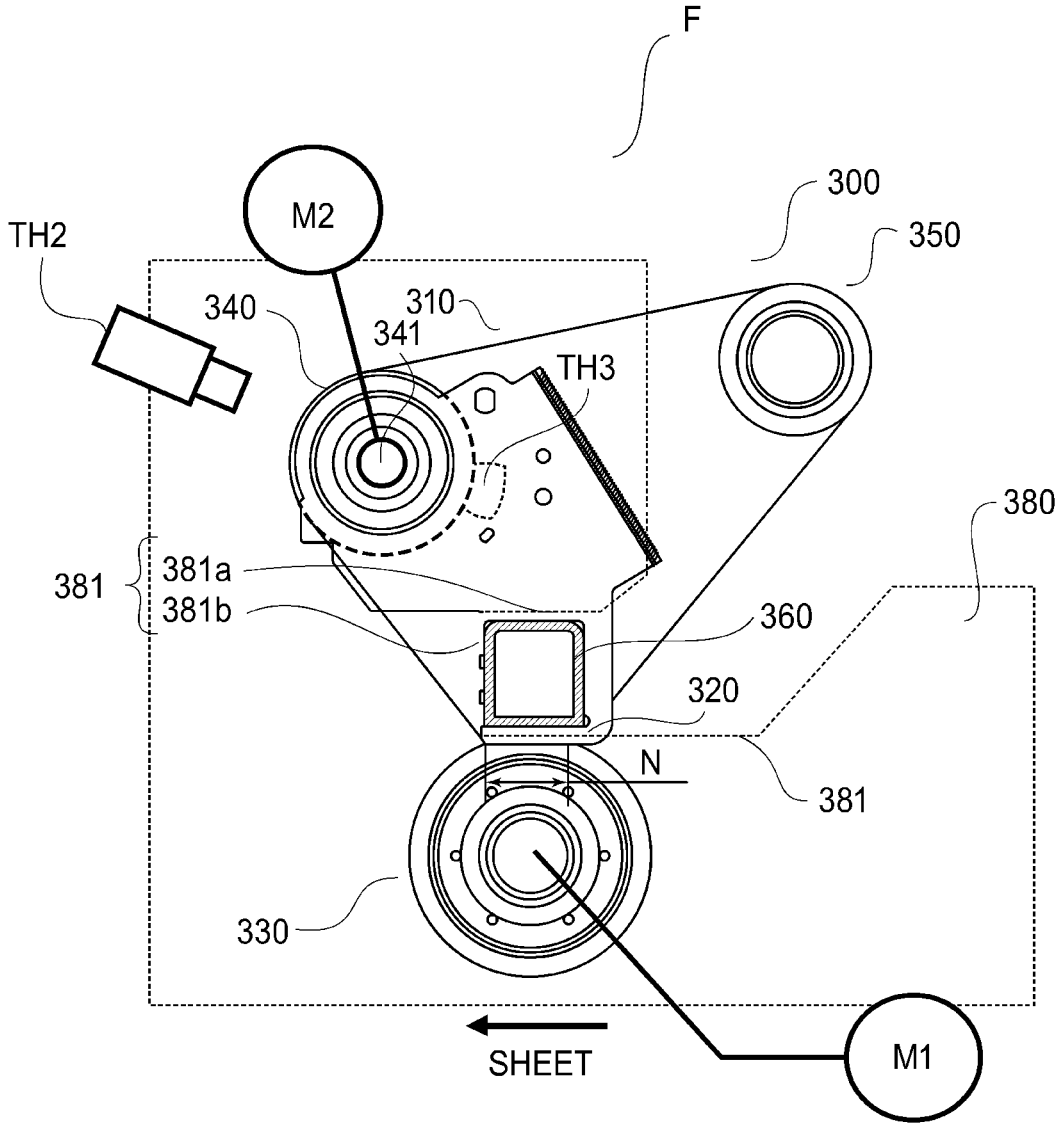
FIG. 1 is a cross sectional view of a fixing device.

FIG. 1 shows a schematic illustration of the overall structure of a belt heating type fixing device F according to an embodiment of the present invention. In FIG. 1, the recording material P is fed in the direction from right to left. Fixing device F includes a fixing belt (hereafter referred to as a belt) 310, a pressure pad (hereafter referred to as a pad) 320, a heating roller 340, a heating unit 300, and a pressure roller 330. The fixing belt is an endless rotatable heating member, and the pressure pad 320 is a fixing member. The heating unit includes a steering roller 350. The pressure roller 330, as a pressing rotatable member, faces the belt and forms a nip portion N in cooperation with the belt.

The belt 310 is thermally conductive, heat-resistive, and it has a cylindrical shape with a thin thickness. In this embodiment, it has a three-layer structure including a base layer, an elastic layer on the outer periphery of the base layer, and a parting layer on the outer periphery. The base layer is 60 μm in thickness and the material thereof is polyimide resin (PI). The elastic layer is silicone rubber with a thickness of 300 μm, and the parting layer is PFA (ethylene tetrafluoride, par fluoroalkoxyethylene copolymer resin). The belt 310 is stretched by the pad 320, the heating roller 340, and the steering roller 350.

The pad 320 is pressed by the pressure roller 330 with the belt 310 interposed therebetween. A lubricating sheet or lubricant is interposed between the pad 320 and the belt 310, and therefore, the belt 310 slides smoothly relative to the pad 320.

The heating roller 340 includes a 1 mm thick stainless-steel pipe. A halogen heater 341 is provided inside the stainless steel pipe, and heat can be generated up to a predetermined temperature. The belt 310 is heated by the heating roller 340, based on temperature detection by a temperature sensor TH2, which will be described hereafter, so that the temperature is controlled to a predetermined target temperature corresponding to the type of the sheet used. In addition, the heating roller 340 has a gear fixed to one end of a shaft thereof. The heating roller 340 is connected to the drive motor M2 via the gear and is driven to rotate. The belt 310 is driven by the rotation of the heating roller 340.

The steering roller 350 has a rotation center at one end or near the center. The steering roller 350 controls the position of the belt 310 in the main scanning direction by pivoting relative to the belt 310 to produce a tension difference between the front and rear. Here, this steering roller 350 is urged by a spring supported by the frame of the heating unit 300, and the steering roller 350 is also a tension roller which applies a predetermined tension to the belt 310.

The pressure roller 330 is a roller including an elastic layer on the outer periphery of the shaft and a parting layer on the outer periphery thereof. The shaft is made of stainless steel, and for the elastic layer, 5 mm thick and conductive silicone rubber is used, and for the parting layer, 50 μm thick PFA as a fluororesin is used. The pressure roller 330 is supported by the fixing frame 380 of the fixing device F. A gear of the pressure roller is fixed to one end portion of the pressure roller 330 and connected to a drive source M1 to rotate the pressure roller 330.

In the nip portion N formed between the belt 310 and the pressure roller 330, the recording material P carrying the toner image is nipped, and the toner image is heated while being fed. As described above, the fixing device F fixes the toner image on the recording material P while nipping and transporting the recording material P. Therefore, the fixing device F has both the function of applying heat and pressure and the function of feeding recording material P.

The fixing frame 380 is provided with a heating unit positioning portion 381, a pressure frame, and a pressure spring 384. The stay 360 of the heating unit 300 is inserted into the heating unit positioning portion 381, and the stay 360 is fixed to the heating unit positioning portion 381 by fixing means (not shown)

After fixing the stay 360, the pressure frame is moved by a drive source and cam (not shown), by which the pressure roller 330 is pressed against the pad 320 by way of the belt 310.

Here, in the heating unit positioning portion 381, the opposite side of the pressure roller 330 is a pressure direction regulating surface 381*a*, and the abutting surface in the inserting direction of the heating unit 300 is the feeding direction regulating surface 381*b*.

A temperature sensor (temperature detection element) TH2, such as a non-contact thermopile, for example, is disposed at a position facing the heating roller 340 by way of the belt 310. This temperature sensor TH2 detects the surface temperature of the belt 310 without contact thereto, and the detected temperature information is fed back to a controller 100, discussed further below.

A temperature sensor (temperature detection element) TH3, such as a thermistor, for example, is disposed in contact with the heating roller 340. The temperature sensor TH3 detects the surface temperature of the heating roller 340, and the detected temperature information is fed back to the controller 100. The controller 100 controls the electric power supply to the halogen heater 341 so that the detected temperature inputted from the temperature sensors TH2 and TH3 is maintained at a predetermined target temperature.

<Control Portion>

Figure 3:
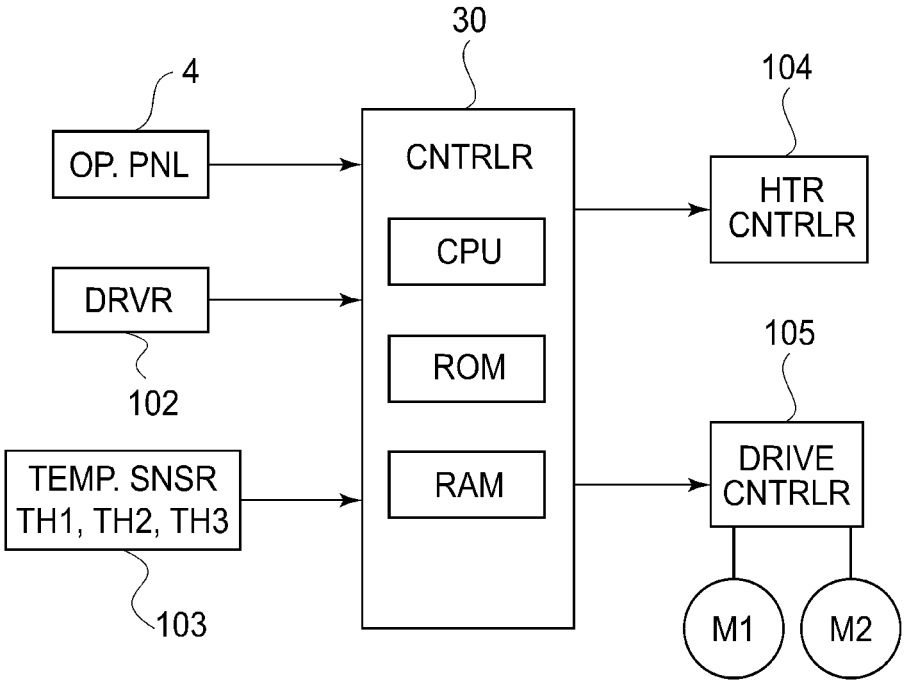
FIG. 3 is a block diagram of the controller.

FIG. 3 shows a structure of the controller of the image forming apparatus related to the fixing device F of this embodiment. The controller includes a CPU (Central Processing Unit), ROM (Read Only Memory), and RAM (Random Access Memory).

The ROM stores an operation control program for this device. The RAM stores temporary calculation results and data. Control of the entire image forming apparatus is performed by the controller 100. Controller 100 is connected with an operating portion 4 and a driver 102. The operating portion includes a liquid crystal touch panel, buttons, and so on. The driver 102 transmits, when printing from a PC, print job information to the controller 102. The image forming apparatus starts its operation in accordance with the input of various conditions supplied from the operating portion 4 and the driver 102. Information such as the size and the basis weight of the sheet to be passed is transmitted from the operating portion 4 and the driver 102 to the controller 100.

The temperature sensor data 103 of the fixing device F is data acquired from the environment temperature sensor TH1 (FIG. 2) for detecting the temperature of the external environment of the image forming apparatus 3, the above-mentioned non-contact thermopile TH2, and the contact type thermistor TH3, and the information is transmitted to the controller 100. The controller 100 operates a heater control means 104 and a drive control means 105, based on the information from the temperature sensors.

The drive control means 105 receives a command from the controller 30 and operates the drive motors M1 and M2 to rotate the pressure roller 330 and the heating roller 340. Drive control for the drive motors M1 and M2 (for example, rotation ON/OFF, peripheral speed, and so on) is performed by the controller 30 by way of the drive control means 105. The drive motor M1 transmits the driving force to the belt 310 by rotating the heating roller 340. In addition, the drive motor M2 rotates the pressure roller 330. As a result, the belt rotates by receiving both the driving force of the driving motor M1 through the heating roller 340 and the driving force of the driving motor M2 through the pressure roller 330.

<Belt Curvature>

Figure 4:
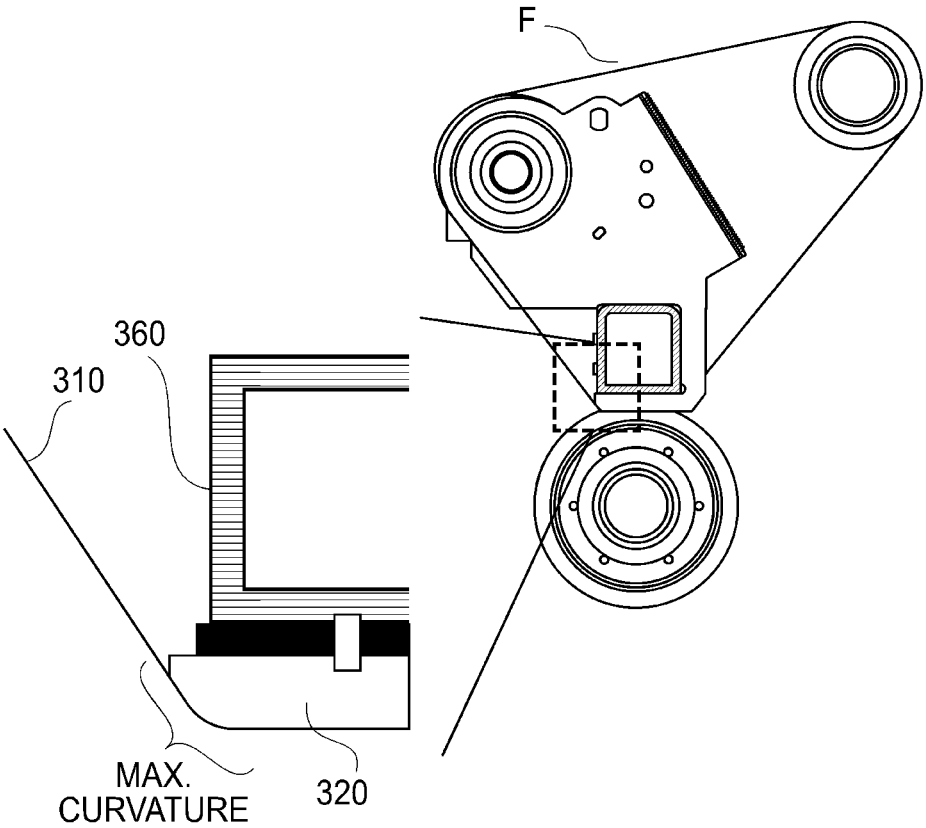
FIG. 4 is an illustration of a maximum curvature Portion of the fixing belt.

As shown in FIG. 4, in the rotational direction of the belt 310 of the belt heating type fixing device F according to the embodiment of the present invention, the position with the largest belt curvature $mm^{-1}$ is the area from the downstream of the nip N to the position where the sheet is separated.

In the present invention, the curvature distribution of the belt 310 is obtained through the following manner.

First, position information is acquired by measuring the track shape of the belt 310 which is at rest, using an ultra-high-speed inline profile measuring instrument LJ-V7000 series (available from Keyence Corporation).

Then, three points are selected from the obtained position information, and the curvature is calculated using circular approximation. The calculation is carried out over the above-described area of the belt 310.

At this time, the smaller the unit length for calculating the curvature of each portion, the more detailed distribution is obtained, but in order to ignore the curvature due to minute unevenness on the belt 310 which does not contribute to the influence on the belt bending which will be described hereafter, it is desirable that the unit length is at least the layer thickness of the belt 310 or more than twice the layer thickness.

In this embodiment, the curvature is determined by setting the unit length to 1 mm.

Figure 5:
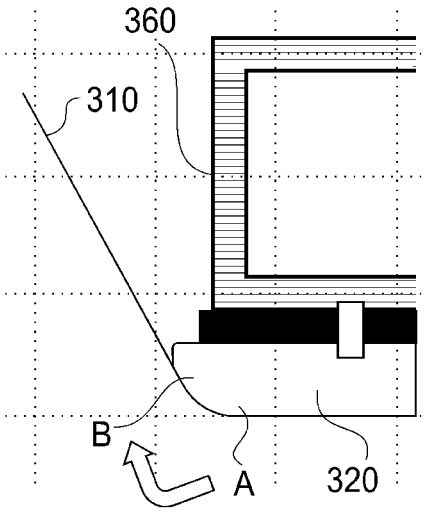
FIG. 5 shows a curvature distribution near the separation portion of the fixing belt.
Figure 5:
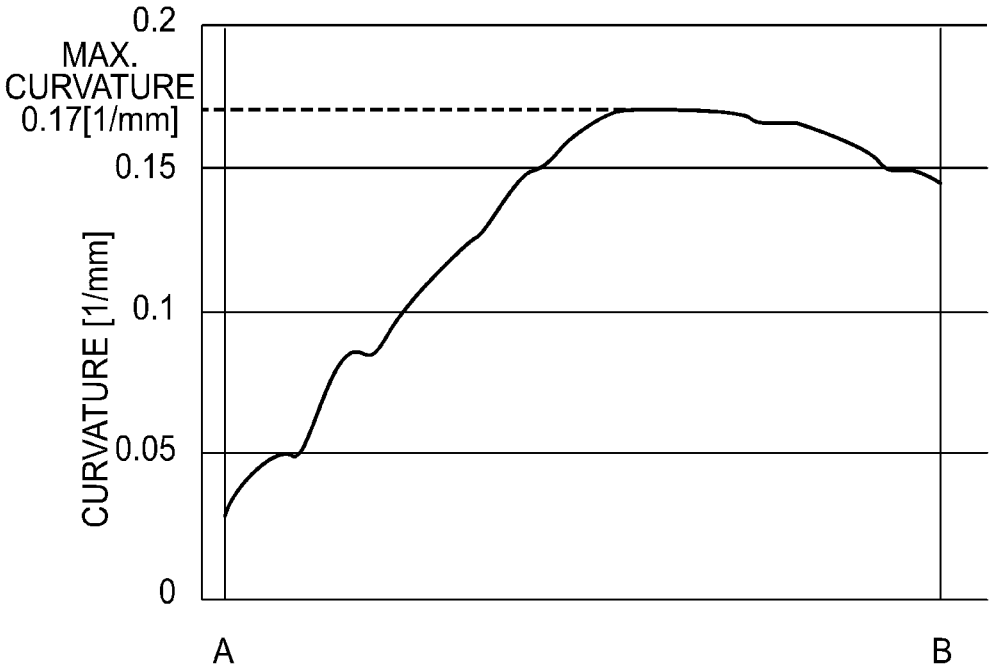

FIG. 5 shows a curvature distribution in the above-described area of the belt 310 of this embodiment. According to the results, it is understood that the maximum curvature of the belt 310 is 0.17 $mm^{-1}$.

In addition, in order to prevent poor peeling of thin sheet with a low basis weight (for example, 52 g/m^2), which is widely usable with the recent market, the curvature of the separation portion is not less than 0.17 $mm^{-1}$, preferably 0.25 $mm^{-1}$.

<Causes of Defective Image Production>

Additionally, the larger the maximum curvature at the separation portion of the belt 310, the better the sheet separation performance, but it has been found that when the curvature is larger than a predetermined amount, the surface parting layer of the belt 310 is deformed at a position corresponding to the maximum curvature portion.

In detail, at the time when fixing device F finishes and stops the sheet passing job, the surface parting layer of the belt 310 exceeds the glass transition temperature, and in such a state, it extends along the maximum curvature portion, and then, it is cooled below the glass transition temperature in this state, for a certain period of time, by which the belt acquires the tendency of keeping the shape (reformation) in this state. When a sheet passing job is instructed then, and the rotating operation starts, the surface parting layer of the belt 310 having acquired such a tendency is moved and stretched, and therefore, it experiences so-called reverse bending in the region between the heating roller 340 and the pad 320.

In order to eliminate the tendency (reformation) on the surface parting layer of the belt 310, the temperature must be raised to the glass transition temperature or higher again, but before reaching it, the surface parting layer will repeatedly bend and bend back every time it goes around by the maximum curvature position and the position between the heating roller 340 and pad 320. If the number of the bending actions exceeds a predetermined number, the reformation due to the tendency is not eliminated, even if the shape of the corresponding portion is heated to a temperature higher than the glass transition temperature.

Through the above-described process, the deformation (set reformation) of the portion of the surface parting layer of the belt 310 appears in the print image after fixing, that is, a defective image results.

Therefore, in order not to produce such a defective image, it is desirable to prevent the non-eliminatable deformation of the surface parting layer of the belt 310.

Here, the glass transition temperature of PFA which is the material of the surface parting layer of the belt 310 is about 100° C.

In addition, the surface parting layer may be a surface parting layer made of a fluororesin, and other than PFA, PTFE (polytetrafluoroethylene), FEP (tetrafluoroethylene, hexafluoropropylene copolymer) or a material comprising any of them are usable, and the glass-containing material of these material, and the glass transition temperature thereof is about 100° C.

<Surface Parting Layer Deformation Conditions>

The conditions under which plastic deformation of the surface parting layer occurs were investigated by the following experiments.

In the fixing device F, the pads having different curvatures in the rotational direction of the separation surface were prepared. In addition, the position of the heating roller 340 is may be adjustable, and the belt 310 is appropriately adjusted so as to follow the separation surface of the pad 320.

When the belt 310 starts rotating from a room temperature state (at least below 50° C. (details will be described hereafter)), and the maximum curvature portion of the belt 310 makes one round and returns to the original position, the bending time is counted one.

Here, if the temperature of the belt 310 exceeds 100° C., the deformation of the surface parting layer is removed, and therefore, the bending count is reset to zero.

In order to evaluate whether or not the surface parting layer of belt 310 was deformed, an entire solid black image was fixed on coated sheet with a basis weight of 300 g/m^2, and it is checked whether or not the surface deformation mark (trace) was found on the fixed image (hereafter referred to as test image). At this time, the recording material conveyance speed was 400 mm/s, and the fixing target temperature was set to 180° C.

Figure 6:
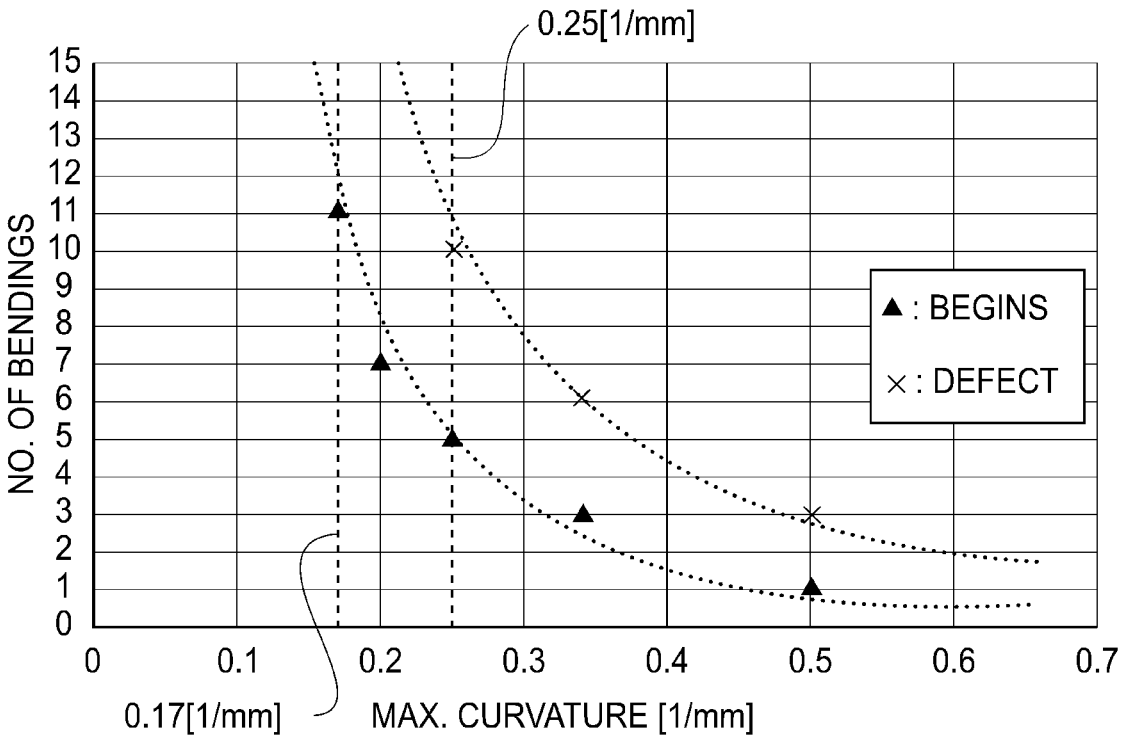
FIG. 6 shows results of bending experiment.

FIG. 6 shows the results of the above-described experiments. The A plot points in FIG. 6 indicate the conditions under which the influence of the above-mentioned surface deformation portions starts to appear in the test image at the number of bendings at the maximum curvature. The number of bendings is further increased from this point, and the condition where a defective image is produced is indicated by x plots in the Figure.

From these results, it has been found that in the case of the maximum curvature of 0.17 $mm^{-1}$, the number of bendings is preferably less than 11, and in the case of the maximum curvature of 0.25 $mm^{-1}$, it is preferably less than 5. However, if the maximum curvature is between 0.17 and 0.25 $mm^{-1}$, the usable range of the number of bendings is less than 10.

Here, as shown in Table 1 below, belts 310 (tests 1 to 3) with different thicknesses were prepared, and each belt was tasted with two levels of maximum curvature of 0.17 $mm^{-1}$ and 0.25 $mm^{-1}$. As a result, all belts in tests 1 to 3 exhibited the same results as in the above-described results 1.

TABLE 1

| | Emb. 1 | Test 1 | Test 2 | Test 3 |
|---|---|---|---|---|
| Reference thickness (μm) | 60 | 100 | 60 | 60 |
| Elastic layer thickness (μm) | 300 | 300 | 450 | 300 |
| Parting layer thickness (μm) | 30 | 30 | 30 | 50 |

In addition, depending on the structure of the fixing device, the maximum curvature point may not be near the separation portion (for example, upstream of the fixing nip part). Even in such a case, the above-described problem occurs, and therefore, there are similar problems.

<Cold Temperature Detection Sequence>

As described in the foregoing, deformation of the surface parting layer is caused by stopping the operation at a temperature above the glass transition temperature, lowering the temperature to below the glass transition temperature, and then keeping the belt at rest for a certain period of time.

In the present invention, this low temperature state at rest for a predetermined time is defined as a cold state, and in a cold temperature detection sequence, it is determined that the cold state has been detected in the following case.

The case that the temperature of the belt 310 is less than 50° C. is detected for more than 5 minutes after the operation stops.

The case that after the operation stops, the temperature of the belt 310 is lower than 10° C.+the temperature of the environmental detected by the temperature sensor TH1, for 1 minute or longer.

The case that after the operation stops, the temperature of the belt 310 becomes the same as the temperature detected by the environmental temperature sensor TH1 even once.

The above conditions are not limiting, and other conditions may be used as long as the temperature is sufficiently low with respect to the glass transition temperature of the surface parting layer and the rest time is enough to keep the tendency (reformation).

<Operation Control>

Since the maximum curvature of the belt 310 of this embodiment is 0.17 $mm^{-1}$, it is necessary to operate such that the temperature of the belt 310 reaches 100° C. or more when the number of bendings is less than 10 times, from the above-described conditions.

There are several similar actions that can be performed, but a typical example will be described below, and other similar operations will be described as a supplement to other operations at the end of this embodiment.

Figure 7:
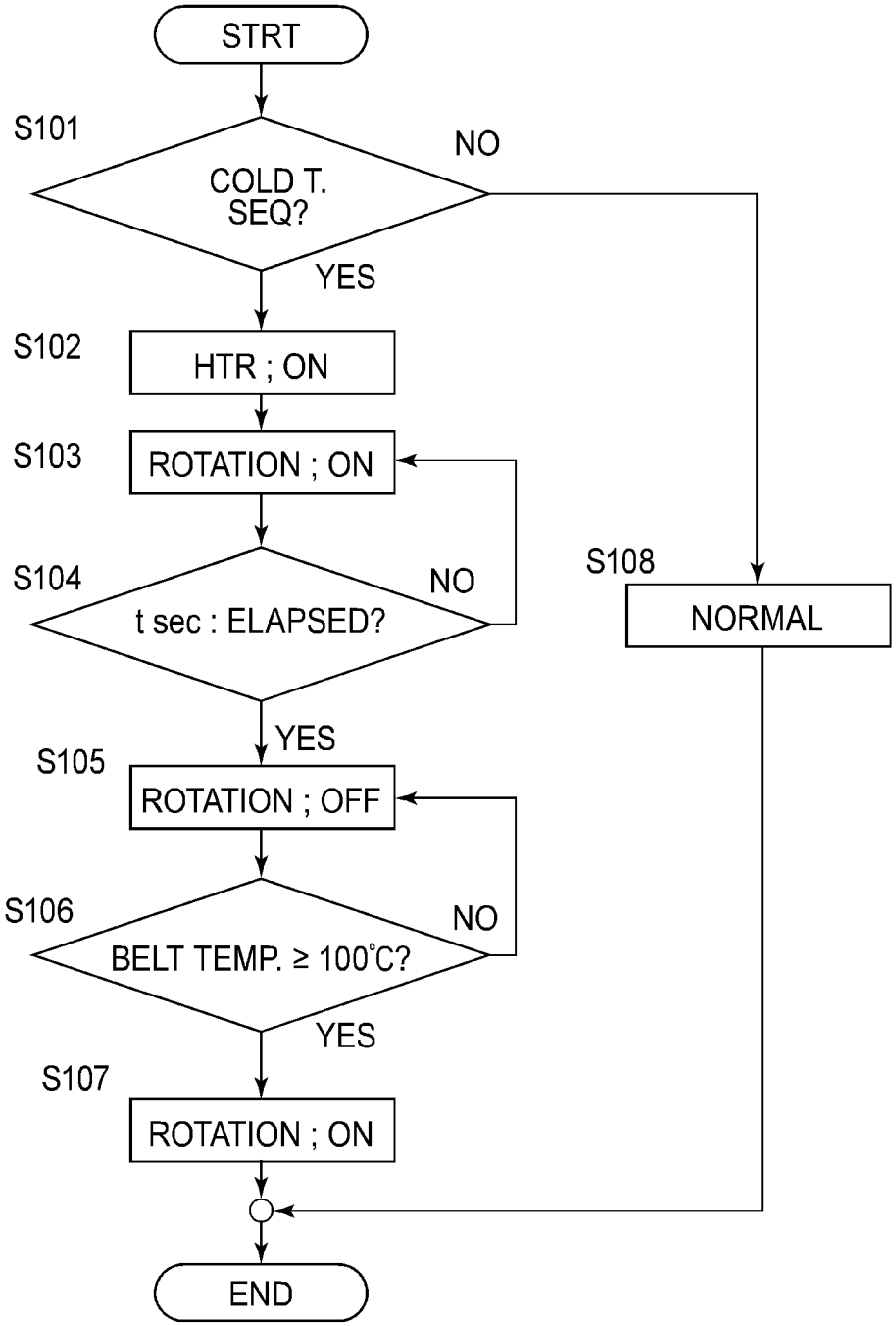
FIG. 7 is a flowchart of an operation of the device of Embodiment 1.

FIG. 7 is a flowchart showing the control executed by the controller 30.

The operation starts when a power ON signal is received from the operating portion 4 or a job start command is received from the driver 102.

In step 101, the production of a cold temperature detection sequence is determined. If it is determined by the controller 30 that the above-described cold temperature detection sequence condition is satisfied, the process proceeds to step 102. On the other hand, if the necessity for the cold state sequence is not detected, the process proceeds to step 108.

If a cold state sequence is determined as being necessary, the operation proceeds to steps 102 to 103, in which electric power is supplied to the halogen heater and the drive motor to start the heating and rotation of the belt 310.

In step 104, it is determined whether t seconds have elapsed or not from the start of rotation, where t seconds is the time required for the maximum curvature portion of the belt 310 to move to a region where the heating roller 340 and the belt 310 are in contact with each other (hereafter referred to as a heating region) The rotation is continued until t seconds elapses.

In step 105, the maximum curvature portion (hereafter, a bending portion) of the belt 310 is stopped at the heating region and is heated.

In step 106, the belt is kept at rest and heated until the temperature of the bending portion becomes 100° C. or higher, as detected by the temperature sensor TH1. When more than 100° C. is detected, the operation proceeds to the next step.

In step 107, the electric power is again applied to the drive motor, and the rotating operation is resumed.

Here, in the normal start-up operation in step 108, the heating and rotating operations are continued until the temperature is adjusted without stopping the rotating operation halfway.

With the above operation, the deformation of the bent portion of the belt 310 can be prevented.

(Another Operation Supplement 1)

In the operation control flow in the embodiment described above, the heating start by the heater and the rotation start are almost simultaneous, but the present invention is not limited to this example, and the belt heating operation may be started after the heating by the heater is started and the predetermined temperature is reached. In addition, the rotation may be started without the heating, and the heating may be started after the bent portion of the belt 310 reaches the heating area.

(Another Operation Supplement 2)

In the operation control flow in the embodiment described above, when the temperature of the belt 310 is detected to be 100° C. or higher, the rotating operation is resumed, but the present invention is not limited to this example, and a predetermined rest time after the bending portion of the belt 310 stops in the heating region and the temperature of the heating roller 340 exceeds 100° C. may be set as a condition for restarting rotation, for example.

(Another Operation Supplement 3)

In the operation control flow in the embodiment described above, the bent portion of the belt 310 stops at the heating region formed by the heating roller 340, but the present invention is not limited to this example, and a halogen heater may be mounted on the steering roller 350 so that the bending portion of the belt 310 is moved to a heating region formed by the steering roller 350 and then stopped and heated. In addition, if it is within the above-described allowable number of bendings the stopping and the heating may be effected in a heating region after carrying out multiple rounding operations.

Embodiment 2

The structure of this example is equivalent to that of Embodiment 1, and therefore, the explanation is omitted.

The operation of Embodiment 2 is different from that of Embodiment 1 described above. More specifically, in this embodiment, the heating is effected by the required amount with low speed operation, without effecting the stopping and heating operation for eliminating the tendency of the bent portion of the belt 310.

In the operation of this embodiment, the number of bending times at the bent portion of belt 310 will increase, but, the entire circumference of belt 310 can be heated evenly, and therefore, it is effective when high image quality is required immediately after startup. In the following, the control operation flow of this embodiment will be described.

<Control>

In this embodiment, as in Embodiment 1, the maximum curvature of the belt 310 is 0.17 $mm^{-1}$, and therefore, the upper limit number of bending times is 10, and the belt 310 is operated so that the bent portion temperature of the belt 310 reaches 100° C. or more with the number of turns within the above-described number range.

There are several similar actions which can be performed, but a typical example will be described below, and other similar operations will be described as a supplement to other operations at the end of this embodiment.

Figure 8:
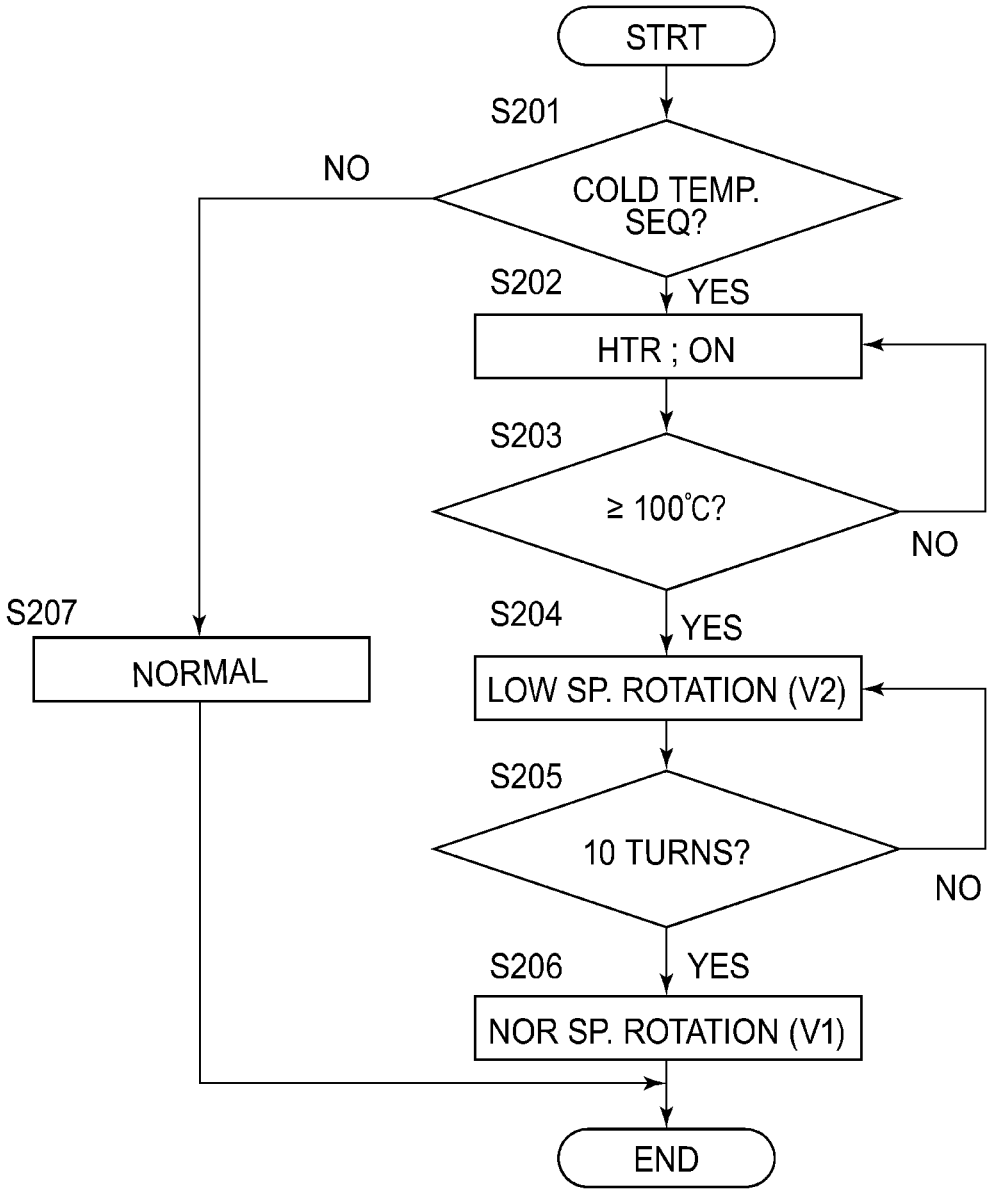
FIG. 8 is a flowchart of an operation of the device according to Embodiment 2.

FIG. 8 is a flowchart showing the control executed by the controller 100.

The operation starts when a power ON signal is received from the operating portion 4 or a job start command is received from the driver 102.

In step 201, the necessity of the cold temperature detection sequence is determined. If it is determined by the controller 30 that the above-described cold temperature detection sequence condition is met, the process proceeds to step 202. On the other hand, if the cold temperature detection sequence is not necessitated, the operation proceeds to step 213 in which the normal startup operation is carried out.

In step 202, the electric power is supplied to the halogen heater to start heating.

In step 203, the drive stop state is continued until the temperature of the heating roller 340 reaches 100° C. or higher.

In step 204, if the temperature of the heating roller 340 exceeds 100° C., the power is supply to the drive motor to start the rotation of the belt 310. At this time, the peripheral speed V2 is slower than the normal peripheral speed V1.

In this embodiment, V1 was 400 mm/s, and V2 was 80 mm/s. The optimum speed differs depending on the structure and various conditions of the fixing device, and therefore, the speeds V1 and V2 are not limited to the exemplary speeds.

In step 205, it is determined whether or not the bent portion of the belt 310 has been rotated 10 times.

In step 205, when the number of rotations is 10, the process proceeds to step 206, in which the peripheral speed is changed to V1 and the operation is shifted to the normal operation.

In this embodiment, the surface temperature of the belt 310 reaches 100° C. By the number of rotations reaching 10.

Here, in the normal start-up operation in step 207, the heating and rotating operations are continued to the target temperature with the peripheral speed V1 kept.

With the above-described operation, the circumferential temperature of the belt 310 can be made to have a uniform distribution while preventing the bending portion of the belt 310 from being deformed.

(Another Operation Supplement 1)

In the operation control flow in the embodiment described above, the stop and heating operation is performed until the temperature of the heating roller 340 reaches the specified temperature (100° C.), but the present invention is not limited to this example, and the rotation may be started before the predetermined temperature is reached. In addition, the start of rotation may be earlier than the start of heating.

(Another Operation Supplement 2)

In the operation control flow in the embodiment described above, the rotational speed is controlled with two levels, namely, the normal constant speed V1 and lower peripheral speed V2, but, the present invention is not limited to this example, and another plurality of peripheral speeds may be used. In addition, multiple speeds may be combined and controlled.

(Another Operation Supplement 3)

In the operation control flow in the embodiment described above, the heating area is the contact area between the heating roller 340 and the belt 310, but the present invention is not limited to this example, and the steering roller 350 is equipped with a halogen heater, and the contact area between the steering roller 350 and the belt 310 may be used as a heating area, and they may coexist.

(Another Operation Supplement 4)

In the operation control flow in the embodiment described above, when the temperature at the bent portion of the belt 310 exceeds the predetermined temperature (100° C.), the peripheral speed is changed to the normal constant speed V1 and the operation is started, but the present invention is not limited to this, and it is also possible to shift to start-up operation with the speed V2 kept.

(Modification)

As mentioned above, although the preferable embodiments of this invention have been described, this invention is not limited to these embodiments, various modifications are possible within the range of the present invention.

(Modification 1)

In the embodiment described above, the heating roller 340 in the heating unit 300 and the halogen heater 341 are provided inside the heating unit 300 as the heating element, but the present invention is not limited to this example. For example, the heating roller 340 and the steering roller 350 may be heated by an exciting coil, or a surface heating element may be used.

(Modification 2)

In the embodiment described above, the pressure roller 330 is provided as the pressure member, but the present invention is not limited to this example. For example, it may be in the form of an endless belt.

In the embodiment described above, the rotatable member and the pressing rotatable member as the pressing member press against the fixing rotatable member. However, the present invention is not limited to this example, and the present invention can be similarly applied to a case where a rotatable member as an opposite member is pressed from a fixing rotatable member side.

(Modification 3)

In the embodiment described above, the pad 320 is arranged as a member which forms the belt track of the belt 310 at the separation portion, but the present invention is not limited to this example. For example, a structure may be employed in which another separate member in addition to the pad 320 may be provided and is inscribed in the separation portion, as a separating member inside the belt 310, and instead of the pad 320, a roll member including an elastic layer may be used.

While the present invention has been described with reference to exemplary embodiments, it is to understood that the invention is not limited to the disclosed exemplary embodiments. The scope of the following claims is to be accorded the broadest interpretation so as to encompass all such modifications and equivalent structures and functions.

The invention claimed is:

1. An image heating device for heating an image formed on a recording material, the image heating device comprising:

a heating source;

a belt configured to be rotated in a rotational direction, said belt being capable of being heated by said heating source to heat the image formed on the recording material, said belt including an elastic layer and a surface layer formed of a fluororesin;

a pressing rotatable member configured to press said belt to form a nip portion for nipping and feeding the recording material;

a pressing member provided inside said belt and configured to press said pressing rotatable member through said belt;

a tension member configured to stretch said belt, wherein said belt is stretched by said pressing member and said tension member with a portion of said belt having a maximum curvature of 0.17 $mm^{-1}$ or more in a circumferential direction of said belt as measured when said belt is at rest; and a controller configured to execute, in a case that an operation signal is inputted when said belt is at rest and has a temperature lower than 50° C., a start-up mode operation in which said belt is rotated, and an outer surface temperature of a portion of said belt having the maximum curvature is raised up to 100° C. or higher before a number of rotations of said belt reaches ten.

2. The image heating device according to claim 1, further comprising a temperature sensor provided opposed to said belt in non-contact with said belt and configured to detect the temperature of said belt.

3. The image heating device according to claim 1, wherein said pressing member includes a pressure pad.

4. The image heating device according to claim 3, wherein the portion having the maximum curvature is at a downstream end of the pressure pad in the rotational direction of said belt.

5. The image heating device according to claim 1, wherein pressing member includes an elastic roller having an elastic layer.

6. The image heating device according to claim 5, further comprising a separation member provided on a downstream side of the elastic roller in the rotational direction of said belt, said separation member being adjacent to said elastic roller and configured to separate the recording material from said belt.

7. The image heating device according to claim 1, wherein a rotational speed of the belt said belt in the start-up mode operation is lower than a maximum rotational speed of said belt during image forming operation.

8. The image heating device according to claim 1, wherein said belt is stretched by a heating roller including said heating source therein.

* * * * *